US008118201B1

(12) United States Patent
Calkin

(10) Patent No.: US 8,118,201 B1
(45) Date of Patent: Feb. 21, 2012

(54) STORAGE AND CARRIER APPARATUS FOR PATIENT TRANSPORT LITTER

(75) Inventor: Carston R. Calkin, Tualatin, OR (US)

(73) Assignee: Skedco, Inc., Tualatin, OR (US)

( * ) Notice: Subject to any disclaimer, the term of this patent is extended or adjusted under 35 U.S.C. 154(b) by 294 days.

(21) Appl. No.: 11/680,540

(22) Filed: Feb. 28, 2007

Related U.S. Application Data

(60) Provisional application No. 60/809,139, filed on May 25, 2006.

(51) Int. Cl.
*A45F 3/14* (2006.01)
*A45F 3/04* (2006.01)

(52) U.S. Cl. ..... 224/156; 224/576; 224/585; 224/645; 224/650; 224/655

(58) Field of Classification Search ..... 224/576, 224/655, 584, 901.8, 153, 585, 627, 645, 224/653, 659, 572, 156, 578, 579, 581, 582, 224/650; 190/108
See application file for complete search history.

(56) References Cited

U.S. PATENT DOCUMENTS

| | | | | |
|---|---|---|---|---|
| 5,154,332 | A * | 10/1992 | Williams et al. | 224/153 |
| 5,803,332 | A * | 9/1998 | Thompson | 224/651 |
| 5,881,708 | A * | 3/1999 | Kliot | 224/653 |
| 6,056,174 | A * | 5/2000 | Minckler | 224/250 |
| 6,123,239 | A * | 9/2000 | Lovitt | 224/413 |
| 6,243,892 | B1 * | 6/2001 | Kelling | 5/413 R |
| 6,279,796 | B1 * | 8/2001 | Trevino | 224/153 |
| 6,347,730 | B1 * | 2/2002 | Frederick | 224/259 |
| 6,460,746 | B1 * | 10/2002 | Amram | 224/579 |
| 6,484,912 | B2 * | 11/2002 | Jones | 224/153 |
| 6,889,882 | B1 * | 5/2005 | Leep | 224/579 |
| 6,948,203 | B2 * | 9/2005 | Tsai | 5/627 |
| 7,461,857 | B2 * | 12/2008 | Darling, III | 280/640 |
| 2003/0197044 | A1 * | 10/2003 | Webb | 224/584 |
| 2008/0011798 | A1 | 1/2008 | Cragg | |

FOREIGN PATENT DOCUMENTS

JP 2001000243 A * 1/2001

OTHER PUBLICATIONS

Notice of Removal and Second Amended Complaint, *Special Operations Technologies, Inc.* v. *Skedco, Inc.* et al., Case No. 3:07-cv-00853-HA (D. Oregon, Portland) Mar. 26, 2007, 26 pages.
Civil Docket, *Special Operations Technologies, Inc.* v. *Skedco, Inc.* et al., Case No. 3:07-cv-00853-HA (D. Oregon, Portland), as of Jul. 1, 2008.
Skedco, Inc., Cunningham II pack, 9 photographs, 3 pages, sold in the U.S. at least as early as Feb. 2004.

* cited by examiner

*Primary Examiner* — Gary Elkins
*Assistant Examiner* — Corey Skurdal
(74) *Attorney, Agent, or Firm* — Stoel Rives LLP

(57) ABSTRACT

An apparatus for carrying a patient transport litter includes a support mount for releasably mounting a separate litter carrier for carrying a patient transport litter. The support mount includes a mounting panel adapted to be mounted to a supporting structure and a pair of flexible side flaps that wrap around the litter carrier to secure the litter carrier to the support mount in a storage condition. Each side flap includes a fastener or buckle component for releasably joining together the respective side flaps snugly around the litter carrier, to thereby releasably secure the litter carrier to the support mount and the supporting structure. The litter carrier may include carrying straps for facilitating transport to a site of injury, where the litter carrier is opened and the patient transport litter removed from the litter carrier for use in transporting an injured person.

26 Claims, 6 Drawing Sheets

STORAGE AND CARRIER APPARATUS FOR PATIENT TRANSPORT LITTER

RELATED APPLICATIONS

This application claims the benefit under 35 U.S.C. §119 (e) from U.S. provisional application No. 60/809,139, filed May 25, 2006, which is incorporated herein by reference in its entirety.

TECHNICAL FIELD

The field of the present disclosure relates to devices for storing a patient transport litter and for facilitating carrying of the patient transport litter to an injured person needing litter transport.

BACKGROUND

Patient transport litters, such as folding type pole litters, are used by medical and emergency personnel for carrying an injured person from a site of an injury to another location and, in some instances, for transporting an injured person in a vehicle, such as an ambulance or helicopter. Folding type pole litters are well known collapsible litters which, when not in use, are arranged to fold into a compact generally elongated block-type storage condition, as is well known in the military and emergency rescue art. The term "patient transport litters", as used herein, is also intended to include collapsible sleds and stretchers, which may be stored in a compact rolled or folded configuration.

The present inventor has recognized a need for an improved device for storing a patient transport litter and for carrying the patient transport litter from a vehicle or other storage location to the site of the injury.

DETAILED DESCRIPTION OF PREFERRED EMBODIMENTS

Figure 1:
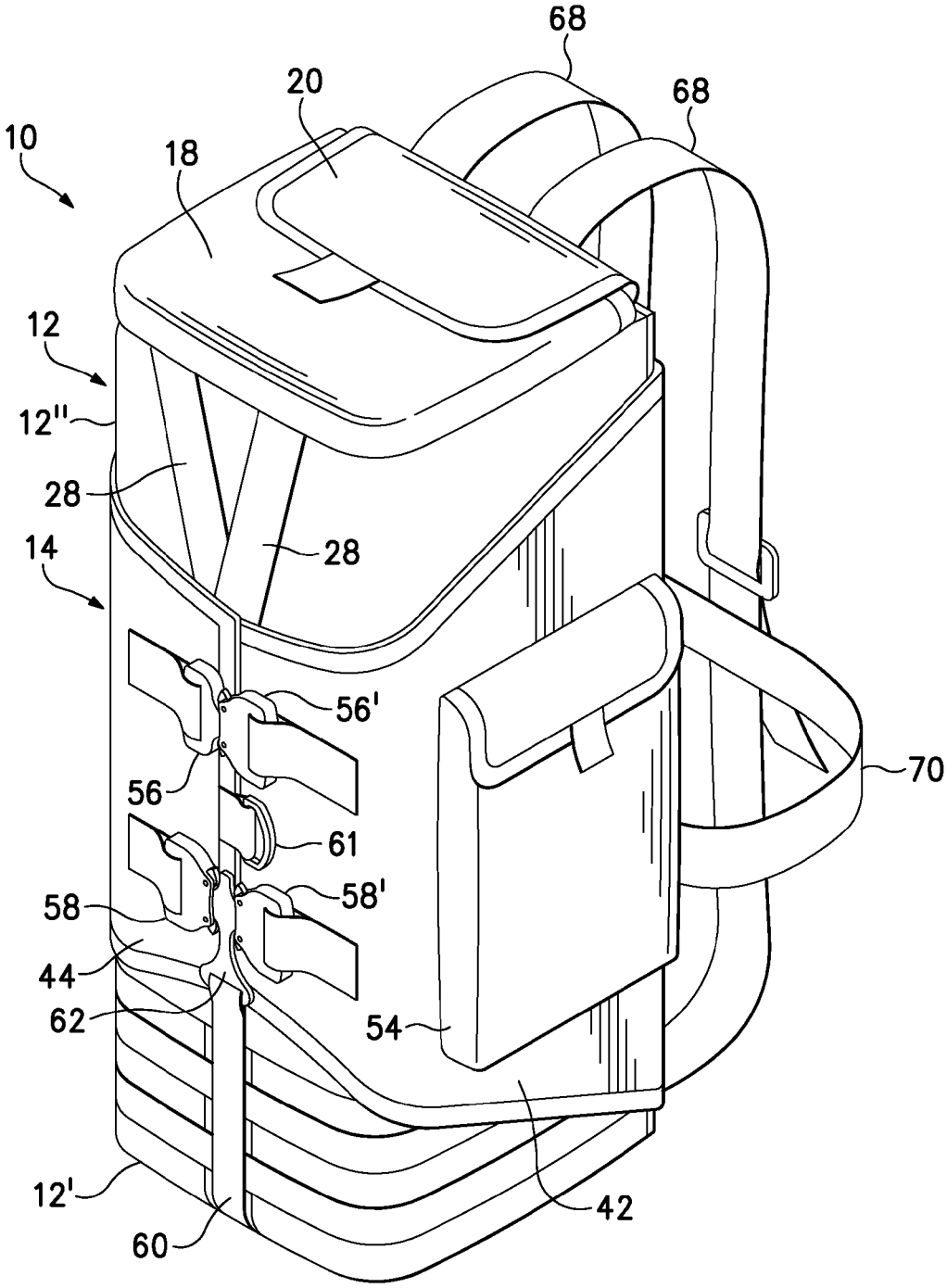
FIG. 1 is a front perspective view of a litter storage and carrier apparatus.
Figure 2:
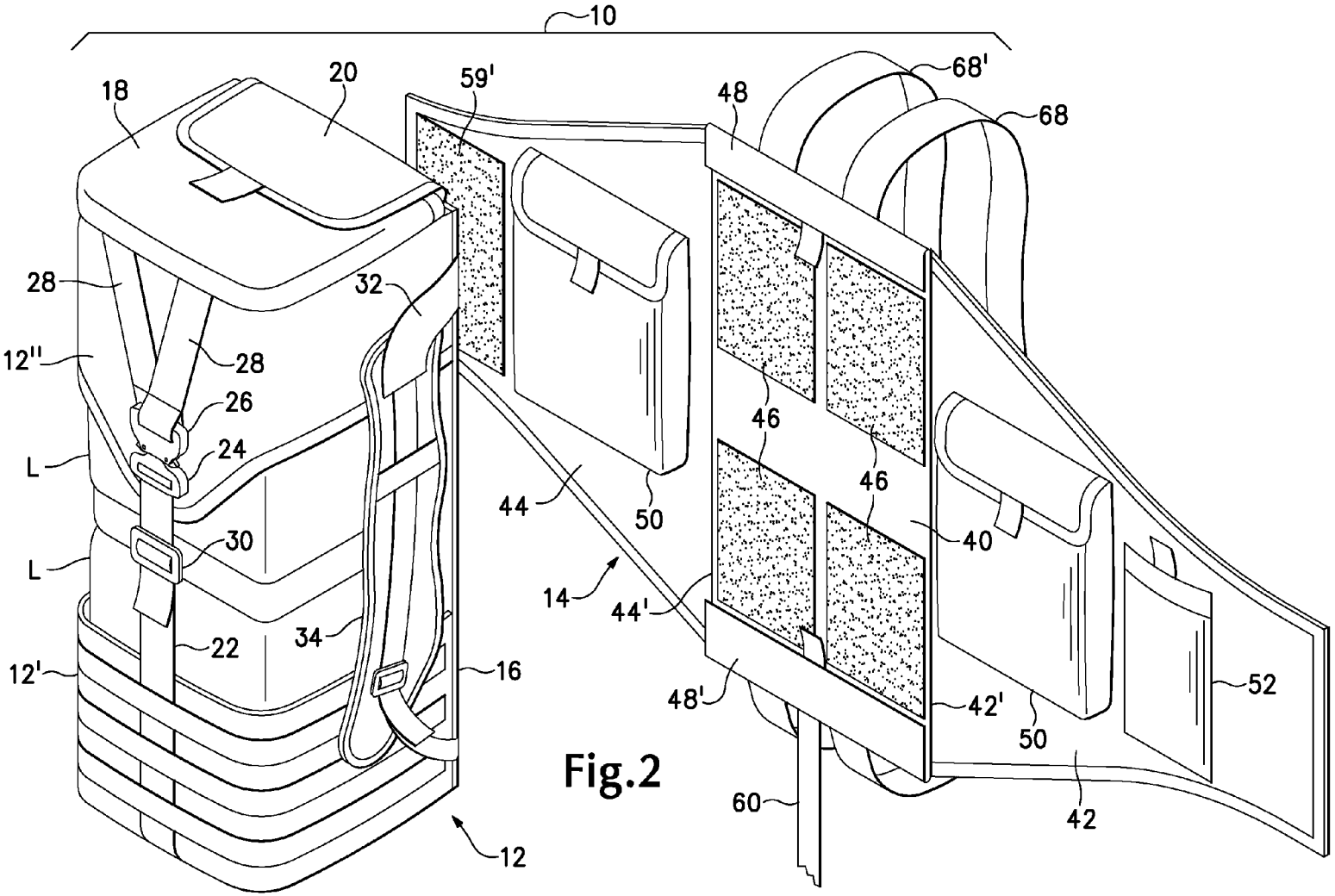
FIG. 2 is a front perspective assembly view of the apparatus of FIG. 1, showing a litter carrier component of the apparatus separated from a support mount component of the apparatus.

FIG. 1 is a front perspective view showing a litter storage and carrier apparatus 10 according to a first embodiment in a complete, connected-together condition ready for mounted securement onto a vehicle. FIG. 2 is a front perspective view of the litter storage and carrier apparatus 10 of FIG. 1 but showing the litter carrier 12 component and the support mount 14 component of the apparatus in condition separated from one another.

Figure 3:
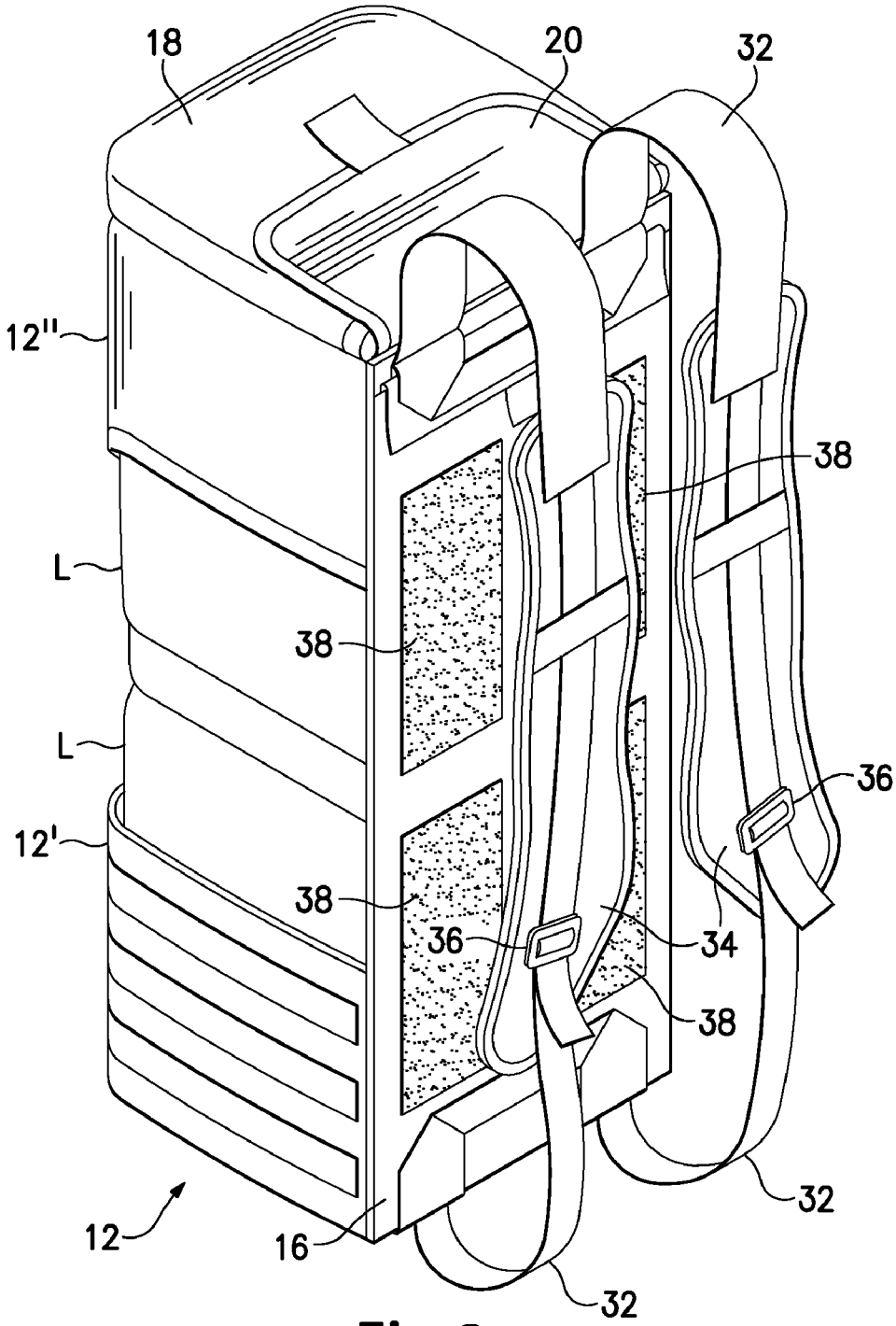
FIG. 3 is a rear perspective view of the litter carrier component of FIG. 2.

First, with reference to the litter carrier 12 component of the assembly, seen best in the front perspective view of FIG. 2 and the corresponding rear perspective view of FIG. 3, the litter carrier 12 comprises a substantially hollow bag or container body 12', 12" configured to receive and confine a folded pole litter L shown schematically in collapsed condition and secured in the container body 12', 12". Although the litter carrier 12 may, if desired, be formed as a substantially rigid, hollow container, it is preferably constructed as a flexible, bag-like member formed of selected flexible fabric material such as canvas or other durable material.

The litter carrier 12 may serve as a bag enclosure with an open top end which may if desired be releasably closed as by a top flap, or the bag member may be provided in the form of an enclosure that is openable along the length of a side wall, not unlike that of an athletic bag construction, or provided in other forms of bag enclosure constructions as may be desired. However, in the preferred embodiment illustrated the litter carrier 12 includes a generally flexible longitudinally elongated back panel 16 connecting a lower bag section 12' to a separate, vertically spaced upper bag section 12". As shown, each bag section 12', 12" includes peripheral side and front walls, the lower bag section 12' also including a bottom bag wall panel and the upper bag section 12" also including a top wall panel 18. In the particular embodiment illustrated, the top wall 18 of the bag is formed with a double thickness of material which forms an interior pocket therebetween, releasably closed by cover flap 20, the pocket for holding medical supplies, etc. as may be desired. The cover flap 20 releasably attaches to the outer surface of the top wall 18 via strips of hook-and-loop fastener material (e.g. VELCRO™) or another kind of fastener.

Means is provided to interconnect and secure the upper and lower bag sections 12', 12" positively in position confining therein a patient transport litter, such as a collapsed pole litter L, as seen in FIG. 2. In the embodiment shown, a strap member 22 may be secured to the lower bag section 12' or to the back panel 16 and extended beneath and upwardly along the lower section 12', the strap extending vertically upwards to a buckle component 24 arranged for releasable connection to a corresponding mating buckle component 26 secured, as by strap members 28 to the upper bag section 12" or to an upper part of back panel 16. A strap adjustment slide member 30 may be provided as shown in order to adjust the length of the strap member 22 to assure positive and snug securement of the upper and lower bag sections 12', 12" to each other for snug confinement of the litter structure L in the litter carrier 12. The extension of the strap member 22 beneath the bottom of the lower bag section 12' may also provide for additional support of the somewhat heavy pole litter assembly carried in the bag litter carrier 12.

As will also be apparent, when it is desired to remove the pole litter L from the bag, the buckle components 24, 26 are disengaged and the upper bag section 12" is lifted upwardly and rotated about its attachment to the rear panel 16, thereby exposing substantially all of the pole litter L except the bottommost portion contained within the lower bag section 12', thus allowing for expedited, unhindered access to the pole litter L for removal when needed at the site of an injury.

As seen best in FIG. 3, the litter carrier bag sections 12' and 12" preferably mount on the back panel 16, and a pair of strap members 32 are provided on back panel 16 opposite bag sections 12', 12" for convenient carrying of the litter carrier 12. As illustrated, these strap members 32 are preferably provided in the form of shoulder strap members which may include resilient padding 34 arranged for comfort when the litter carrier 12 is being carried by a user in a backpack condition. Adjustment slide members 36 may be provided for the strap members 32 in order to provide for adjustability of fit. The shoulder straps may also, if desired, be held in a hand of a user for carrying the litter carrier 12 as may be necessary when the user is already carrying a backpack.

As will be appreciated in viewing FIGS. 1 and 2 of the drawings, the litter carrier 12 is provided for quick-release attachment onto the carrier support mount 14 for releasable but positive securement as is hereinafter described. Although the litter carrier 12 may be releasably mounted to the support mount 14 in many different ways suitable for quick release, in the preferred embodiment illustrated in FIG. 3 the exterior face of the back panel 16 of litter carrier 12 bears a first component 38 of a two-part heavy duty hook and loop type fastener, such as the loop fabric component of VELCRO™ fastener material. In the particular arrangement illustrated, this first component is provided in four individual quarter sections of first component members 38 secured to back panel 16 in a spaced-apart configuration. Alternatively the first component members may be configured as a plurality of vertically elongated strips or as a large single member, if so desired as an alternative to the four quarter sections 38.

Figure 4:
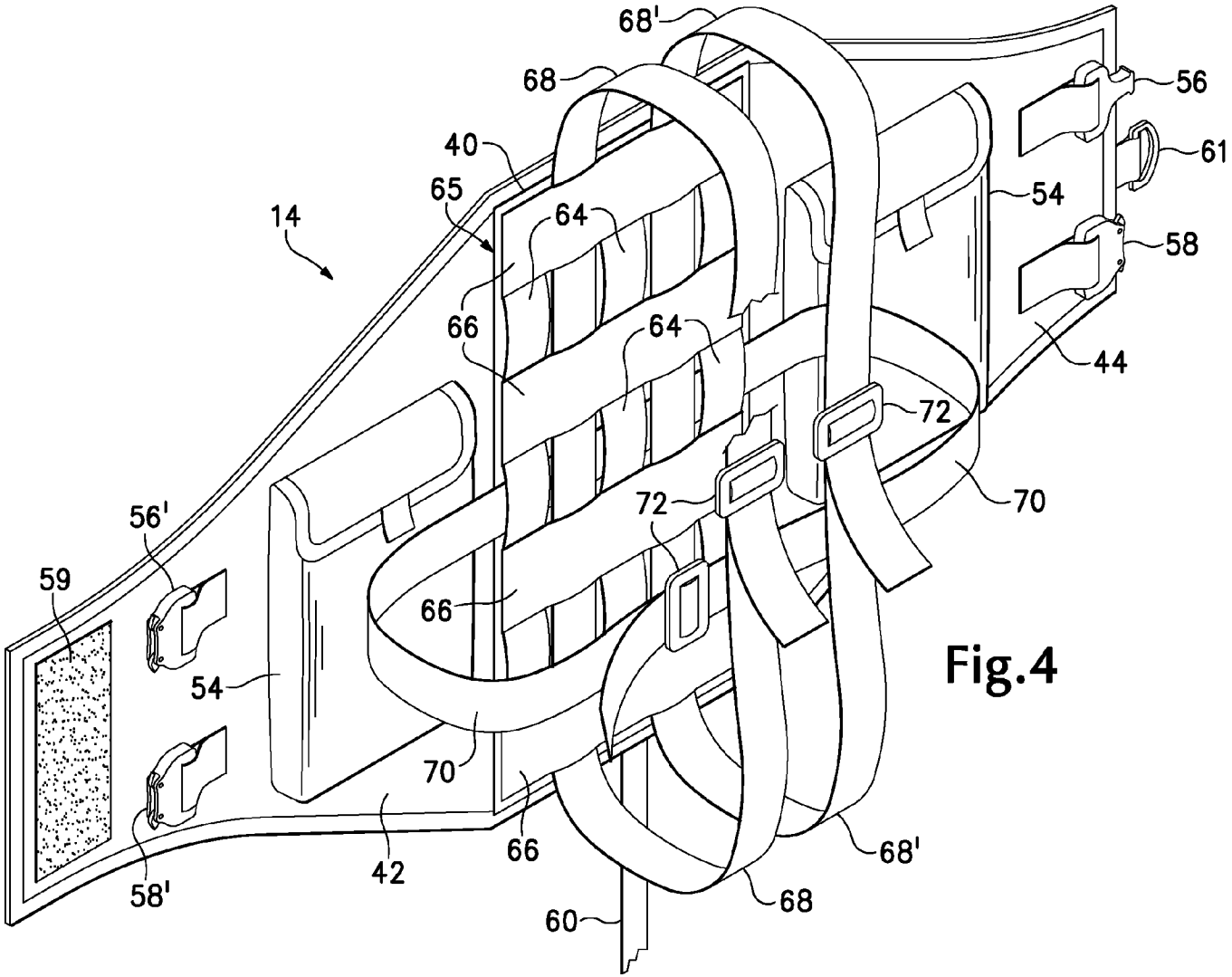
FIG. 4 is a rear perspective view of the support mount component of FIG. 2.

Turning now to FIGS. 2 and 4, the support mount 14 is shown in an open condition not mounted on a supporting structure, the front side being seen in the front perspective view of FIG. 2 and the rear side being shown in the rear perspective view of FIG. 4. As shown, the support mount 14 is preferably formed as a laterally elongated sheet of flexible fabric material such as canvas or other durable material and defining a central mounting panel 40 and opposing left and right flexible side flaps 42, 44 extending laterally from left and right side margins of mounting panel 40 and arranged to pivot or bend along their connecting borders 42' 44' to the mounting panel 40.

As seen in FIG. 2, the front (or inner) face of the central mounting panel 40 bears the second component 46 of the aforementioned two part hook and loop fastener apparatus, e.g. VELCRO™-type hook material, which cooperates with the aforementioned first component 38 on litter carrier 12. The litter carrier 12 may be attached to the support mount 14 by simply pressing the back panel 16 of litter carrier 12 against the mounting panel 40 of the support mount 14 for interengagement of the corresponding first and second hook and loop fastener components 38, 46.

The litter carrier 12 may then be readily removed from its mounted engagement on the support mount 14 by simply pulling on the litter carrier 12 to separate the interengaging hook and loop members 38, 46. It is to be understood that while a quick-release mounting connection arrangement is illustrated herein as utilizing a heavy duty hook and loop type fastener apparatus, many other suitable types of releasable securement arrangements may be utilized as alternatives if so desired.

The mounting panel 40 may, if desired, include a space or pocket between its front side wall and rear side wall if desired for holding a rigid stiffener panel member (not shown), such as a plastic sheet, which may be provided to assure positive interengagement of the first and second fastener components 38, 46. The stiffener member may be removably contained within the pocket and prevented from inadvertent removal by top and/or bottom pocket closure flap members 48, 48'.

Also, the inner surfaces of the side flaps 42, 44 may support storage pocket members 50, 52 for convenient storage of desired small articles. As seen in FIG. 4, the opposite, outer surfaces of the side flaps 42, 44 may support similar storage pockets 54 if desired for additional storage of supplies, etc.

As will be understood in viewing FIG. 1 of the drawings, the side flaps 42, 44 are configured, when the carrier litter 12 is secured to the central mounting panel 40 by interengaging hook and loop components 38, 46 or other releasable securement arrangement alternatively provided, to extend around the sides and front of the litter carrier 12 and be secured together, as by first and second sets of interengaging quick-release buckle components 56, 56', 58, 58'. In this manner the carrier mounting member 14 serves as a supporting jacket arranged to snugly confine the litter carrier 12 in mounted condition on the support mount 14 and positively retain the litter carrier 12 against inadvertent separation from the support mount 14. The side flaps 42, 44 may include overlapping regions bearing mating sections of hook-and-loop fastener material 59, 59' (FIGS. 2 and 4), which assist in closure of side flaps 42, 44 and holding them in place while the first and second set of buckle components 56, 56', 58, 58' are joined. A handle 61 may be provided at a distal end of one of the side flaps 44 to facilitate separating the sections of hook-and-loop fastener material 59, 59' and opening the side flaps 42, 44 for accessing litter carrier 12.

The support mount 14 may include a support strap 60 arranged to extend downwardly from mounting panel 40, beneath the litter carrier 12 and upwardly for connection, as by T-connector member 62, to the side flaps 42, 44 coupled together via T-connector 62 by one of the sets of buckle components 58, 58' at the front of the apparatus 10, thereby forming a three-way harness around the litter carrier. In this manner, the weight of litter carrier 12 and its contents, including the litter L is positively transferred to the support mount 14, which in turn is securely mounted on a supporting structure as is hereinafter explained. This arrangement also assures positive confining, mounting engagement of the litter carrier 12 with the support mount 14 against unintentional separation due to virtually any lateral and vertical forces and impact that may be applied against the apparatus 10 when mounted on a vehicle or other supporting structure.

A securement lattice 65 is provided for mounting the support mount 14 to a selected supporting structure such as a vehicle. In the embodiment illustrated in FIG. 4, the exterior rear (or outer) side of the center mounting panel 40 mounts a plurality (three in the embodiment shown) of vertically-extending, laterally spaced apart parallel securement straps 64 extending from the top to the bottom of the central mounting panel 40. The mounting panel 40 also mounts as shown, a plurality (four illustrated in this embodiment) of laterally-extending, vertically spaced apart parallel securement straps 66. As will be apparent to those skilled in the art of strap attachment systems, the laterally extending, vertically spaced apart parallel securement straps 66 are secured to the supporting center mounting panel 40 so that vertically aligned columns of spaced-apart open channels are provided between the outer face of the mounting panel 40 and the securement straps 66 for passage therebetween of one or more vertically extending attachment straps 68, 68' as shown in the drawings. In the same manner, the vertically extending, laterally spaced apart parallel securement straps 64 are secured in similar fashion to the center mounting panel 40 in order to provide laterally aligned rows of spaced-apart open channels for passage therethrough of one or more lateral attachment straps 70. The vertical and laterally spaced securement straps 64, 66 overlap to form the securement lattice structure 65 and define spaced-apart vertical and lateral channels between the lattice structure 65 and the mounting panel 40, which channels are adapted to threadably receive one or more attachment straps 68, 68', 70 for mounting the support mount 14 to a supporting mount such as a vehicle.

Preferably the vertical attachment straps 68, 68' and lateral attachment straps 70, 70', 70" are provided with means for adjustment of their length and tensioning such as can be provided by adjustment slide members 72.

Figure 5:
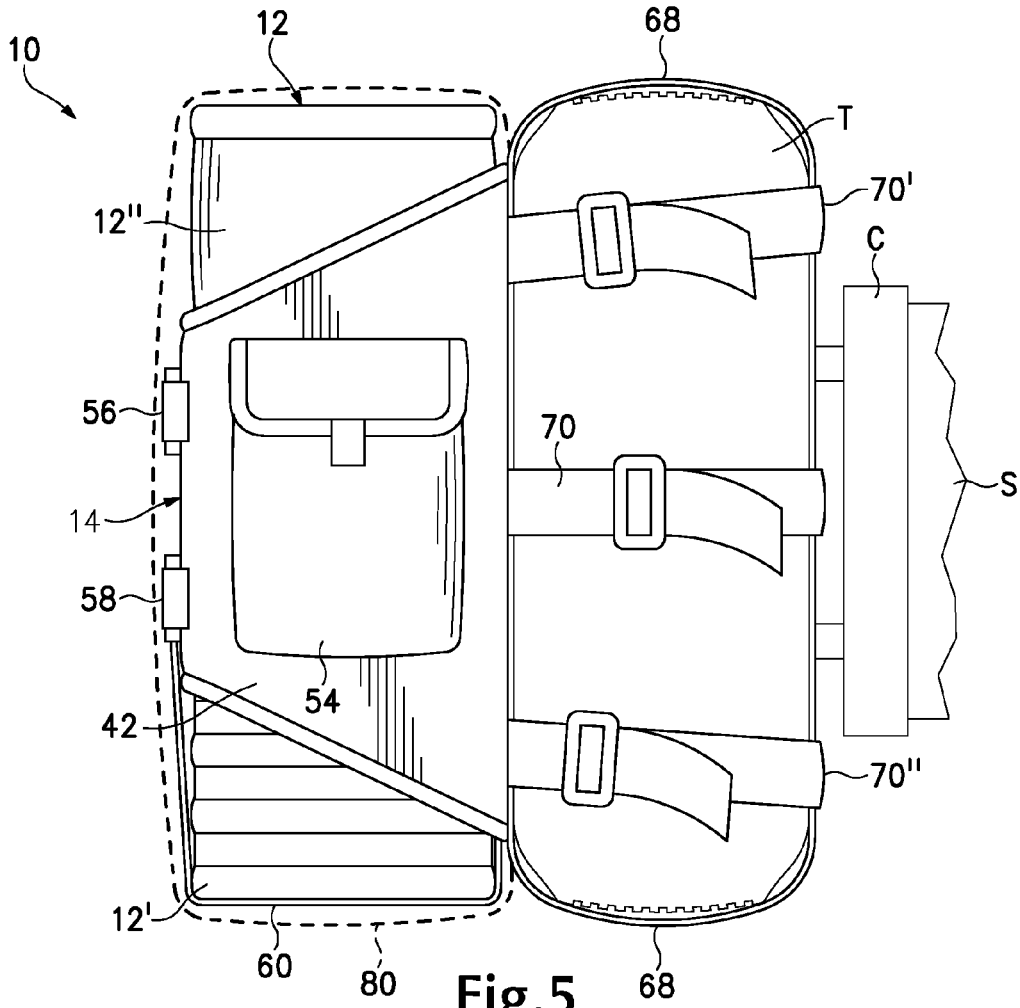
FIG. 5 is a fragmentary side elevation view of the apparatus of FIG. 1 shown mounted for storage on an external spare tire of a vehicle, with dashed lines illustrating a removable shroud shown in FIGS. 7 and 8.

FIG. 5 is a fragmentary side elevational view illustrating the apparatus 10 in a condition of use supported on a support structure S such as a vehicle having a spare tire T mounted on a tire carrier structure C secured to the vehicle. In this arrangement, the support mount 14 is secured by a plurality of straps 70, 70', 70" engaging the laterally aligned channels provided by the vertical securement strap 64 and a vertically extending strap 68 engaging a selected row of vertically aligned channels provided by the laterally extending securement straps 66. Illustrated in dashed lines is a removable protective shroud 80, which may serve to protect apparatus 10 from weather, tampering, and theft.

Figure 6:
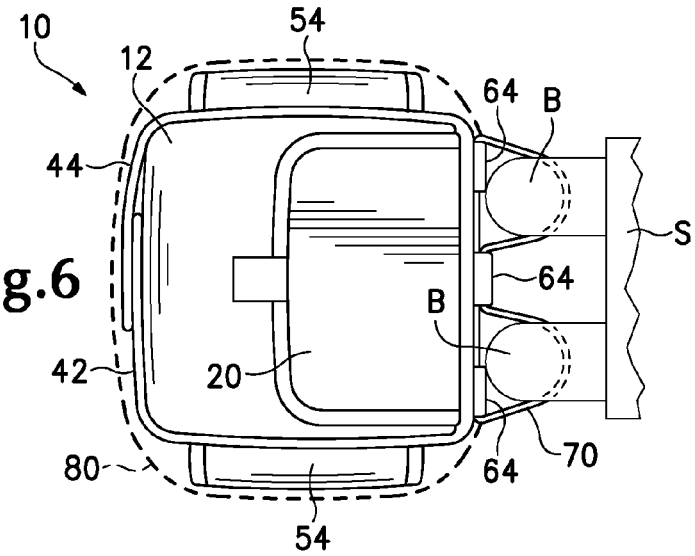
FIG. 6 is a fragmentary top plan view of the apparatus of FIG. 5, mounted to an alternate mounting support including a pair of parallel vertical bars.

FIG. 6 is a fragmentary top plan view of apparatus 10 supported on a supporting structure, which may be a vehicle, having vertically extending bar members B mounted thereon, as is typically provided on military vehicles. In this arrangement a plurality of attachment straps 70 are extended in an interweaving condition through laterally aligned channels provided by vertically extending securement straps 64 and the bar members B as shown. This arrangement provides for a secure attachment of the support mount 14 to the supporting bar members B, and by adjusting the straps 70 via slides 72 to tighten them after the straps 70 have been interwoven, the frictional tension positively securing the apparatus tightly to the supporting mount bars and against vertical sliding movement thereon. The same type of interweaving strap securement arrangement may be utilized on applications where the support bars might be horizontally extending, simply by using the channel arrangement provided by the laterally extending, vertically spaced apart securement straps 66 and strap members 68.

The mounting arrangements shown in FIGS. 5 and 6 are merely illustrative of a variety of mounting arrangements that may be possible with the aforementioned strap securement arrangement previously described.

Figure 7:
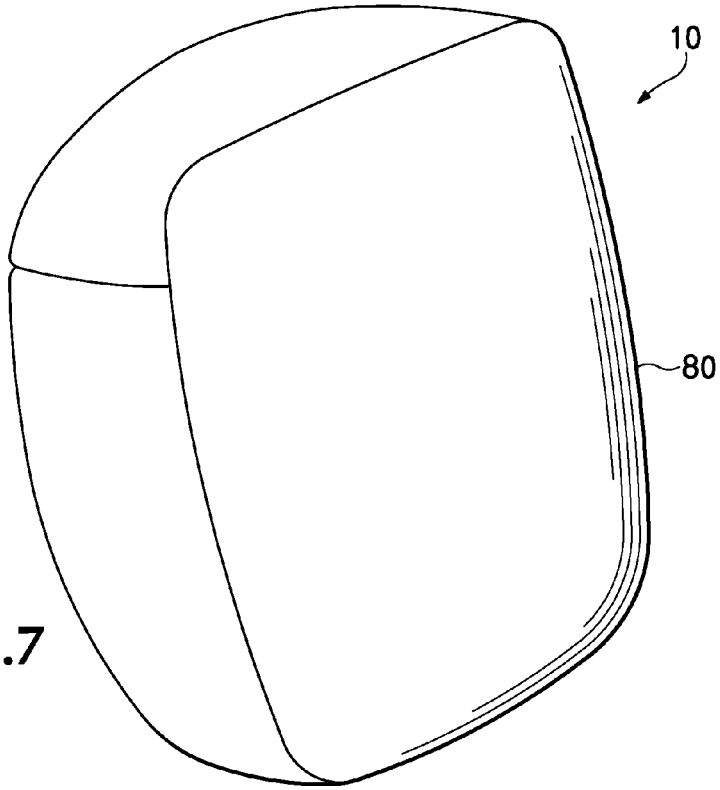
FIG. 7 is a front perspective view of the apparatus of FIG. 1 covered by a removable protective shroud.
Figure 8:
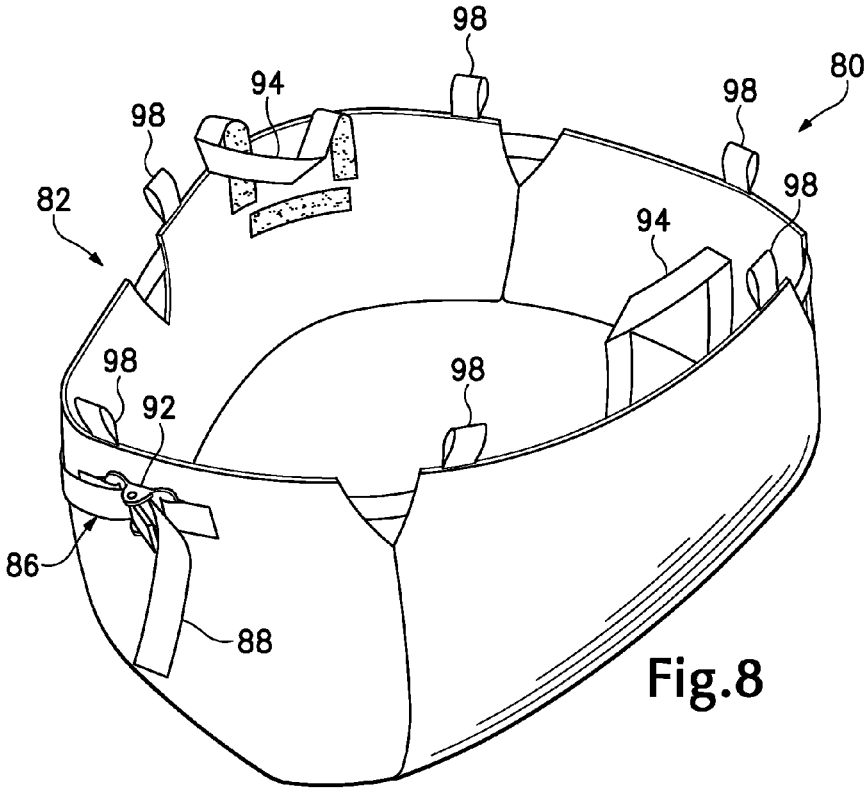
FIG. 8 is a perspective view of the protective shroud of FIG. 8 shown removed from the litter storage and carrier apparatus, with its opening facing upward in a duffel bag configuration and one of a pair of carrying handles deployed.

FIG. 7 is a front perspective view of the apparatus 10 shown covered by protective shroud 80. FIG. 8 is a perspective view of shroud 80 removed from the apparatus and laid open with an opening 82 of the shroud facing upward in a duffel bag configuration. With reference to FIGS. 7 and 8, opening 82 allows shroud 80 to be fitted over apparatus 10, and conversely receives apparatus 10 within an interior of the shroud 80. Shroud 80 includes an adjustable draw-closure device 86 comprising at least one draw strap 88 or cord, and preferably two draw straps, threaded through a passage extending around the mouth of opening 82. Pulling on draw strap 88 reduces the size of the opening 82 and draws the shroud more tightly around the support mount 14 and litter carrier 12 when shroud 80 is placed thereon. The draw-closure device 86 includes a buckle 92 cooperating with strap 88 to maintain the size of opening 82. Buckle 92 may be manually actuated for releasing strap 88, for increasing the size of opening 82, to thereby enable removal of the shroud from the support mount 14 and litter carrier 14. Handles 94 may be provided along the sides of shroud 80 for converting shroud 80 to a carry bag. Handles 94 may be folded back or retracted, when shroud 80 is in use as a protective cover, and retained against an inner surface of shroud 80 via hook-and-loop fastener strips. Draw-closure device 86 also allows the opening 82 to be adjusted to facilitate use of shroud 80 as a carrying bag, for example for carrying personal effects and gear of an injured person from the site of injury. A set of cinch loops 98 are provided around the perimeter of the opening 82 to enable the shroud 80 or bag to be drawn closed or otherwise secured with a cord, zip-tie, or cable-lock.

It will be obvious to those having skill in the art that many changes may be made to the details of the above-described embodiments without departing from the underlying principles of the invention. The scope of the present invention should, therefore, be determined only by the following claims.

The invention claimed is:

1. An apparatus for carrying a patient transport litter, comprising:

a litter carrier for carrying a patient transport litter to a site of use, the litter carrier supporting and confining the patient transport litter, the litter carrier manually openable to release the patient transport litter from the litter carrier for use, the litter carrier including (i) a back panel, (ii) a first shoulder strap sized and arranged to form a first vertically extending loop that receives a wearer's left shoulder, and (iii) a second shoulder strap sized and arranged to form a second vertically extending loop that receives the wearer's right shoulder, the first and second shoulder straps being spaced apart horizontally over the back panel for carrying of the litter carrier and patient transport litter on a wearer's back; and a support mount for releasably mounting the litter carrier when not in use, the support mount including a mounting panel adapted to be mounted to a supporting structure and a pair of flexible side flaps secured to and extending laterally from the mounting panel, the side flaps sized to wrap around the litter carrier when the litter carrier is positioned adjacent an inner face of the mounting panel of the support mount, each side flap having a buckle component for releasably joining together the respective side flaps snugly around the litter carrier; and a support strap extending beneath the litter carrier and upwardly to a connector member at a distal end of the support strap, the connector member releasably couplable to both of the buckle components of the side flaps at a front side of the apparatus opposite the mounting panel, to thereby releasably secure the litter carrier to the support mount and the supporting structure.

2. The apparatus of claim 1, wherein:

an exterior face of the back panel bears a first component of hook-and-loop fastener material; and the inner face of the mounting panel bears a second component of hook-and-loop fastener material, the first and second components cooperating to releasably fasten the litter carrier to the support mount when the respective back panel and mounting panel are placed in adjacent facing relationship, the side flaps joining together snugly around the litter carrier to further secure the litter carrier to the support mount.

3. The apparatus of claim 1, wherein the side flaps of the support mount are arranged to overlap along overlapping portions and be further joined together by cooperating components of hook-and-loop fastener material attached to the overlapping portions of the side flaps.

4. The apparatus of claim 3, further comprising a release handle attached to one of the side flaps for pulling apart the components of the hook-and-loop fastener material.

5. The apparatus of claim 1, further comprising a securement lattice secured to an outer face of the mounting panel of the support mount opposite the inner face thereof, the securement lattice forming a plurality of aligned channels between the securement lattice and the mounting panel, the channels threadably receiving at least one strap for securing the support mount to the supporting structure.

6. The apparatus of claim 1, further comprising a shroud having an opening for receiving the litter carrier and support mount for placement of the shroud over the litter carrier and support mount, the shroud further including an adjustable draw-closure device extending around the opening, the draw-closure device adapted for changing the size of the opening and for drawing the shroud around the support mount and the litter carrier when the shroud is placed thereon, the draw-closure device releasable for increasing the size of the opening to thereby enable removal of the shroud from the support mount and litter carrier.

7. The apparatus of claim 1, wherein at least one of the side flaps supports a storage pocket along an inner surface of the side flap facing the litter carrier when the litter carrier is secured to the support mount, the storage pocket being accessible when the side flaps are unjoined and spread apart to release the litter carrier.

8. A backpack carrier for storing a foldable stretcher and detachably mounting to a transportation tool, wherein said backpack carrier comprises:

a lightweight but durable fabric made backpack body, which is adapted for being carried by a user, which comprises a back panel, an upper holder provided at an upper edge of said back panel, and a separate lower holder provided at a lower edge of said back panel and vertically spaced apart from the upper holder to define a receiving cavity with said back panel, said upper holder, and said lower holder for receiving said foldable stretcher in said receiving cavity;

first and second quick-releasing fasteners provided at said upper and lower holders respectively opposite the back panel and fastenable together for retaining said foldable stretcher in said receiving cavity, wherein said first and second quick-releasing fasteners are adapted for being quickly unfastened by said user to take said foldable stretcher out of said backpack body; and a transportation carrier, comprising:

a carriage sleeve detachably mounting to said backpack body for securely locking said foldable stretcher in said receiving cavity; and a transportation mount provided at said carriage sleeve for detachably mounting said backpack body to said transportation tool, wherein said backpack carrier is adapted to be used between a transportation-carriage mode and a user-carriage mode, wherein at said transportation-carriage mode, said backpack body is carried by said transportation tool for being transported, and at said user-carriage mode, said backpack body is quickly detached from said transportation carrier for said user to carry.

9. The backpack carrier, as recited in claim 8, wherein said first quick-releasing fastener comprises a first length-adjustable strap extended from said upper and lower holders, and a buckle socket provided at said first length-adjustable strap, wherein said second quick-releasing fastener comprises a second length adjustable strap, and a buckle head which is provided at said second length-adjustable strap and is detachably engaged with said buckle socket to hold said upper and lower holders in position for retaining said foldable stretcher in said receiving cavity.

10. The backpack carrier, as recited in claim 8, wherein said upper holder has a top fabric panel, and an upper peripheral fabric downwardly extended from said top fabric panel to define an upper portion of said receiving cavity, wherein said lower holder has a bottom fabric panel and a lower peripheral fabric upwardly extended from said bottom fabric panel to define a lower portion of said receiving cavity, wherein said upper portion and said lower portion of said receiving cavity are arranged to respectively receive an upper portion and a lower portion of said foldable stretcher for allowing said foldable stretcher to be quickly taken out from said receiving cavity of said backpack body.

11. The backpack carrier, as recited in claim 9, wherein said upper holder has a top fabric panel, and an upper peripheral fabric downwardly extended from said top fabric panel to define an upper portion of said receiving cavity, wherein said lower holder has a bottom fabric panel and a lower peripheral fabric upwardly extended from said bottom fabric panel to define a lower portion of said receiving cavity, wherein said upper portion and said lower portion of said receiving cavity are arranged to respectively receive an upper portion and a lower portion of said foldable stretcher for allowing said foldable stretcher to be quickly taken out from said receiving cavity of said backpack body.

12. A storage and deployment system for a patient transport litter, comprising:

a fabric-made backpack body including a back panel, an upper bag section provided at an upper end of said back panel, and a separate lower bag section provided at a lower end of said back panel, said upper and lower bag sections spaced apart to define a receiving cavity with said back panel, said upper bag section, and said lower bag section for receiving said foldable stretcher in said receiving cavity;

first and second quick-releasing buckle components attached to said upper and lower bag sections, respectively, and fastenable together for retaining said foldable stretcher in said receiving cavity, wherein said first and second quick-releasing buckle components are adapted for being quickly unfastened by said user to take said foldable stretcher out of said backpack body; and a transportation carrier, comprising:

a carrier support mount detachably mounting to said backpack body for securely locking said foldable stretcher in said receiving cavity; and a transportation mount provided at said carrier support mount for detachably mounting said backpack body to said vehicle, wherein said backpack carrier is adapted to be used between a storage mode and a deployment mode, wherein at said storage mode, said backpack body is securely retained by said transportation carrier for storage or transport, and at said deployment mode, said backpack body is detached from said transportation carrier for said user to carry.

13. The backpack carrier, as recited in claim 12, wherein said upper bag section has a top fabric panel and an upper peripheral fabric downwardly extended from said top fabric panel to define an upper portion of said receiving cavity, wherein said lower bag section has a bottom fabric panel and a lower peripheral fabric upwardly extended from said bottom fabric panel to define a lower portion of said receiving cavity, wherein said upper portion and said lower portion of said receiving cavity are arranged to respectively receive an upper portion and a lower portion of said foldable stretcher for allowing said foldable stretcher being quickly taken out from said receiving cavity of said backpack body.

14. The backpack carrier, as recited in claim 12, wherein said carrier support mount comprises a fabric-made main sleeve having a shape and size encirclingly and transversely wrapping around said backpack body, a first sleeve buckle component provided at a side edge of said main sleeve, and a second sleeve buckle component which is provided at an opposed side edge of said main sleeve and is detachably fastened with said first sleeve buckle component to detachably attach said main sleeve around said backpack body at a position that said main sleeve is tightly wrapped around said backpack body to cover said first and second quick-releasing buckle components so as to lock up said foldable stretcher in said receiving cavity.

15. The backpack carrier, as recited in claim 13, wherein said carrier support mount comprises a fabric made main sleeve having a shape and size encirclingly and transversely wrapping around said backpack body, a first sleeve buckle component provided at a side edge of said main sleeve, and a second sleeve buckle component which is provided at an opposed side edge of said main sleeve and is detachably fastened with said first sleeve buckle component to detachably attach said main sleeve around said backpack body at a position that said main sleeve is tightly wrapped around said backpack body to cover said first and second quick-releasing buckle components so as to lock up said foldable stretcher in said receiving cavity.

16. The backpack carrier, as recited in claim 14, wherein said carrier support member further comprises a plurality of hook fasteners provided on said main sleeve and a plurality of loop fasteners provided on a rear side of said back panel of said backpack body to detachably fasten with said hook fastener so as to detachably mount said backpack body with said carrier sleeve in a rapidly detaching manner.

17. The backpack carrier, as recited in claim 15, wherein said carrier support member further comprises a plurality of hook fasteners provided on said main sleeve and a plurality of loop fasteners provided on a rear side of said back panel of said backpack body to detachably fasten with said hook fastener so as to detachably mount said backpack body with said carrier sleeve in a rapidly detaching manner.

18. The apparatus of claim 1, wherein:

the litter carrier includes a top end and a bottom end opposite the top end;

the support mount includes (i) a top end configured to be adjacent the top end of the litter carrier when the support mount releasably mounts the litter carrier and (ii) a bottom end opposite the top end and configured to be adjacent the bottom end of the litter carrier when the support mount releasably mounts the litter carrier;

the first shoulder strap includes a first end secured proximate the top end of the litter carrier and a second end secured proximate the bottom end of the litter carrier to extend the first loop over the back panel; and the second shoulder strap includes a first end secured proximate the top end of the litter carrier and a second end secured proximate the bottom end of the litter carrier to extend the second loop over the back panel.

19. The apparatus of claim 18, wherein the side flaps of the mounting panel are connected between the top end and the bottom end of the support mount to extend laterally from the mounting panel in a direction transverse to the first and second loops.

20. An apparatus for casualty evacuation, comprising:

a litter carrier for carrying a patient transport litter to a site of use, the litter carrier including (i) a back panel with an exterior face bearing a first component of hook-and-loop fastener material, the back panel having opposite top and bottom ends, (ii) a bag portion attached to the back panel, the bag portion supporting and confining the patient transport litter and manually openable to release the patient transport litter from the litter carrier for use, (iii) a pair of shoulder straps each having first and second ends secured to the back panel proximate the respective top and bottom ends thereof to form first and second shoulder loops spaced apart and extending over the back panel, the first and second shoulder loops sized and arranged to fit around a wearer's left and right shoulders, respectively, for carrying the litter carrier and patient transport litter on a wearer's back; and a support mount for releasably mounting the litter carrier to a vehicle or other supporting structure, the support mount including:

a mounting panel including an outer face adapted to be secured to a vehicle or other supporting structure, and an inner face bearing a second component of hook-and-loop fastener material that interengages with the first component of hook-and-loop fastener material on the back panel of the litter carrier to releasably fasten the litter carrier to the support mount when the respective back panel and mounting panel are placed in adjacent facing relationship, and a pair of flexible side flaps attached to and extending laterally from the mounting panel transversely of the first and second shoulder loops when the respective back panel and mounting panel are placed in adjacent facing relationship, the side flaps sized to wrap around the litter carrier when the litter carrier is positioned adjacent an inner face of the mounting panel of the support mount, each side flap having a buckle component for releasably joining together the respective side flaps snugly around the litter carrier to thereby maintain positive contact between the first and second hook-and-loop fastener material and to secure the litter carrier to the support mount and the supporting structure, wherein the first and second components of hook-and-loop fastener material comprise the sole means of attaching the litter carrier to the support mount when the side flaps are not joined together around the litter carrier, such that the litter carrier is detachable from the support mount by releasing the buckle components and pulling the litter carrier from the support mount to disengage the first and second components of hook-and-loop fastener material, and thereafter wearable as a backpack for carrying the patient transport litter.

21. The apparatus of claim 20, in which the support mount further includes a support strap extending downwardly from the mounting panel, the support strap adapted to extend under the litter carrier when the litter carrier is secured to the support mount and to releasably connect to at least one of the side flaps.

22. The apparatus of claim 20, further comprising a support strap extending under the litter carrier when the litter carrier is secured to the support mount and upwardly to a strap buckle component at a distal end of the support strap, the strap buckle component releasably connectable together with both of the buckle components of the side flaps at a front side of the apparatus opposite the mounting panel to form a three-way harness around the litter carrier.

23. The apparatus of claim 20, wherein the bag portion of the litter carrier includes an upper bag section attached proximate the top end of the back panel opposite the shoulder straps, the upper bag section including a top panel and peripheral walls attached to and depending downwardly from the top panel toward a separate lower bag section attached proximate the bottom end of the back panel opposite the pair of shoulder straps, the lower bag section including a bottom panel and peripheral walls attached to and extending upwardly from the bottom panel toward the upper bag section, the upper and lower bag sections cooperating to define a receiving cavity for the patient transport litter, wherein the upper bag section covers a top portion of the patient transport litter, the lower bag section covers a bottom portion of the patient transport litter, and the upper and lower bag sections are joined along a first side by the back panel and spaced apart along a second side opposite the first side and joined together along the second side by a buckle.

24. The apparatus of claim 20, in which the outer face of the mounting panel of the support mount carries a securement lattice forming a plurality of aligned channels between the securement lattice and the mounting panel, the channels threadably receiving a plurality of attachment straps for securing the support mount to a vehicle or other structure.

25. The apparatus of claim 24, in which the mounting panel is stiffened by a rigid stiffener panel contained within the mounting panel.

26. The apparatus of claim 5, in which the mounting panel is stiffened by a rigid stiffener panel contained within the mounting panel.

* * * * *